US005242261A

United States Patent [19]

Pollich et al.

[11] Patent Number: 5,242,261

[45] Date of Patent: Sep. 7, 1993

[54] DEVICE FOR UNITING A RESIDUAL PILE OF SHEETS AND A MAIN PILE OF SHEETS

[75] Inventors: Gerhard Pollich, Heidelberg; Erich M. Zahn, Eppelheim; Heiner Luxem, Wilhelmsfeld, all of Fed. Rep. of Germany; Michael Nübel, Holzerlingen, Fed. Rep. of Germany

[73] Assignee: Heidelberger Druckmaschinen AG, Heidelberg, Fed. Rep. of Germany

[21] Appl. No.: 939,455

[22] Filed: Sep. 2, 1992

[30] Foreign Application Priority Data

Sep. 2, 1991 [DE] Fed. Rep. of Germany ..... 4129164

[51] Int. Cl.[5] ..... B65H 3/00

[52] U.S. Cl. ..... 414/795.8; 414/794.3; 271/218; 271/158

[58] Field of Search ..... 271/218, 158, 159; 414/795.8, 793.4, 793.8, 794.3

[56] References Cited

U.S. PATENT DOCUMENTS 5,074,745 12/1991 Neri ..... 414/795.8
5,096,372 3/1992 Maejima ..... 414/795.8
5,160,129 11/1992 Siriporn et al. ..... 271/218

FOREIGN PATENT DOCUMENTS 1321222 12/1989 Japan .

*Primary Examiner*—H. Grant Skaggs

*Attorney, Agent, or Firm*—Herbert L. Lerner; Laurence A. Greenberg

[57] ABSTRACT

A device for uniting residual sheet pile and a main sheet pile into an aggregate pile, wherein a lowermost sheet of the residual sheet pile rests on an uppermost sheet of the main sheet pile, includes a pile-carrying plate having a horizontally oriented upper side whereon the residual sheet pile rests with its lowermost sheet prior to a performance of a pile uniting process, the pile-carrying plate having mutually parallel grooves formed on the upper side thereof, an auxiliary carrying device for temporarily carrying the residual sheet pile including an assembly of horizontally disposed and mutually parallel lattice bars fitting into respective cross sections of the grooves formed in said pile-carrying plate and combined into a rake, guide rails whereon said rake is mounted so as to be displaceable in the longitudinal direction of the lattice bars, a stop rail extending transversely to and being displaceable in the longitudinal direction of the lattice bars, the stop rail being formed with penetrations through which the lattice bars are capable of passing through the stop rail, an auxiliary carrying device having a frame, the guide rails and the stop rail being fixed components of the frame, the frame being mounted within the auxiliary carrying device so as to be displaceable in the longitudinal direction of the lattice bars and in a horizontal plane transverse to the longitudinal direction of the lattice bars.

2 Claims, 11 Drawing Sheets

Fig.8
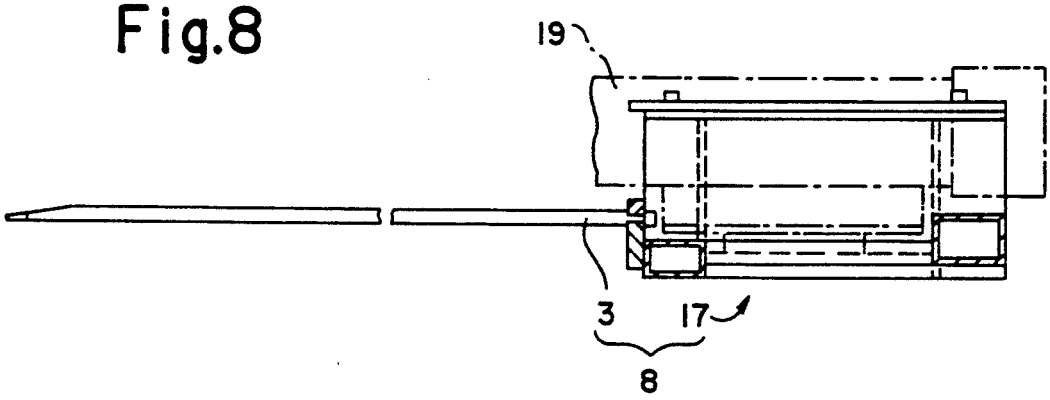
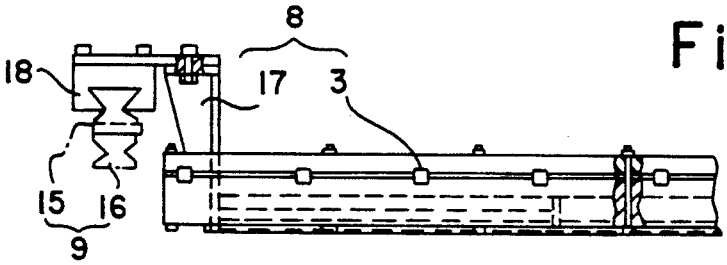
Fig.9
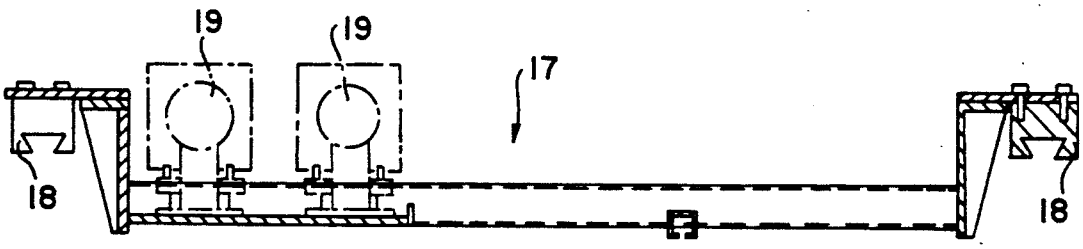
Fig.10

DEVICE FOR UNITING A RESIDUAL PILE OF SHEETS AND A MAIN PILE OF SHEETS

The invention relates to a device for uniting a residual pile of sheets and a main pile of sheets into an aggregate pile, wherein a lowermost sheet of the residual pile of sheets rests on an uppermost sheet of the main pile of sheets, including a pile-carrying plate having a horizontally oriented upper side whereon the residual pile of sheets rests with its lowermost sheet prior to a performance of a pile uniting process, the pile-carrying plate having mutually parallel grooves formed on the upper side thereof, an auxiliary carrying device for temporarily carrying the residual pile of sheetsincluding an assembly of horizontally disposed and mutually parallel lattice bars fitting into respective cross sections of the grooves formed in the pile-carrying plate and combined into a rake, guide rails whereon the rake is mounted so as to be displaceable in the longitudinal direction of the lattice bars, a stop rail extending transversely to and being displaceable in the longitudinal direction of the lattice bars, the stop rail being formed with penetrations through which the lattice bars are capable of passing through the stop rail, the lattice bars being insertable in the longitudinal direction thereof into the grooves formed in the pile-carrying plate so as to underpin the residual pile of sheets, in a phase of the pile uniting process, and in a further phase of the pile uniting process, the pile carrying plate being removed from the residual pile of sheets, the residual pile of sheets resting with its lowermost sheet on the lattice bars, and the main pile of sheets being in contact with its uppermost sheet from below against the lattice bars and, in a final phase of the pile uniting process, the lattice bars, situated between the residual pile of sheets and the main pile of sheets, being pulled in a removal direction, while the stop rail is brought into contact against the residual pile of sheets and the main pile of sheets so that the sheets of the residual pile of sheets and of the main pile of sheets which are in vicinity of the lattice bars are prevented from being displaced in the removal direction.

Such a device has become known heretofore from the Japanese publication Hei 1-321222 (A). In the device of this Japanese publication, the guide rails are adjustable in height along vertically extending guides cooperating directly with the guide rails. Consequently, the rake is displaceable only in the vertical and longitudinal direction of its lattice bars. The safe and reliable operation of the heretofore known device is thus possible only if assurance is provided, in all cases, that the lateral positions of the lattice bars and the grooves are opposite one another within narrow limits. It is not possible, however, for this requirement to be met in all cases.

It is accordingly an object of the invention to provide a device of the foregoing general type, the safe and reliable operation of which is also ensured even if the lattice bars are not in such lateral positions that, when they are displaced in their longitudinal direction, they can be inserted into the grooves which are at the identical height thereof.

With the foregoing and other objects in view, there is provided, in accordance with the invention, a device for uniting a residual pile of sheets and a main pile of sheets into an aggregate pile, wherein a lowermost sheet of the residual pile of sheets rests on an uppermost sheet of the main pile of sheets, comprising a pile-carrying plate having a horizontally oriented upper side whereon the residual pile of sheets rests with its lowermost sheet prior to a performance of a pile uniting process, the pile-carrying plate having mutually parallel grooves formed on the upper side thereof, an auxiliary carrying device for temporarily carrying the residual pile of sheets comprising an assembly of horizontally disposed and mutually parallel lattice bars fitting into respective cross sections of the grooves formed in the pile-carrying plate and combined into a rake, guide rails whereon the rake is mounted so as to be displaceable in the longitudinal direction of the lattice bars, a stop rail extending transversely to and being displaceable in the longitudinal direction of the lattice bars, the stop rail being formed with penetrations through which the lattice bars are capable of passing through the stop rail, the lattice bars being insertable in the longitudinal direction thereof into the grooves formed in the pile-carrying plate so as to underpin the residual pile of sheets, in a phase of the pile uniting process and, in a further phase of the uniting process, the pile-carrying plate being removed from the residual pile of sheets, the residual pile of sheets resting with its lowermost sheet on the lattice bars and the main pile of sheets being in contact with its uppermost sheet from below against the lattice bars and, in a final phase of the uniting process, the lattice bars, situated between the residual pile of sheets and the main pile of sheets, being pulled in a removal direction, while the stop rail is brought into contact against the residual pile of sheets and the main pile of sheets so that sheets of the residual pile of sheets and of the main pile of sheets which are in vicinity of the lattice bars are prevented from being displaced in the removal direction, an auxiliary carrying device having a frame, the guide rails and the stop rail being fixed components of the frame, and the frame being mounted within the auxiliary carrying device so as to be displaceable in the longitudinal direction of the lattice bars and in a horizontal plane transverse to the longitudinal direction of the lattice bars.

The device according to the invention can be used in an advantageous manner particularly in conjunction with a sheet feeder of a printing press in which the lateral position of the carrying plate of a residual pile of sheets in the sheet feeder is changed during a production run in order to retain a desired lateral position of the uppermost sheets in the sheet feeder, even if the piles of sheets are laterally askew or bent. Thus, the device according to the invention is particularly suitable for us in conjunction with sheet feeders of printing presses in which relatively low demands are placed on the lateral alignment of the piles with regard to the pre-piled sheets to be printed.

Moreover, the invention permits the lateral orientation of the rake with respect to the lateral position of the grooves in the pile-carrying plate so that it is possible, simultaneously, to retain reliable guidance of the free ends of the lattice bars in the penetrations of the stop rail. The possibility of effecting such a reliable guidance is provided, in accordance with the invention, by a common lateral orientation or alignment of the rake and the stop rail.

In accordance with another feature of the invention, the auxiliary carrying device comprises a cross-slide arrangement formed of a cross-slide and a telescopic slide, the cross-slide being horizontally displaceable transversely to the longitudinal direction of the lattice bars, and the telescopic slide comprising a first slide forming the frame and being guided by the cross-slide in the longitudinal direction of the lattice bars, and a second slide forming the rake and being guided by the first slide in the longitudinal direction of the lattice bars.

Other features which are considered as characteristic for the invention are set forth in the appended claims.

Although the invention is illustrated and described herein as embodied in a device for uniting a residual pile of sheets and a main pile of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 8 is a cross-sectional view of FIG. 7 taken along the line VIII—VIII in the direction of the arrows;

FIG. 9 is another fragmentary cross-sectional view of FIG. 7 taken along the line IX—IX in the direction of the arrows;

FIG. 10 is a further sectional view of FIG. 7 taken along the line X—X in the direction of the arrows;

Figure 1:
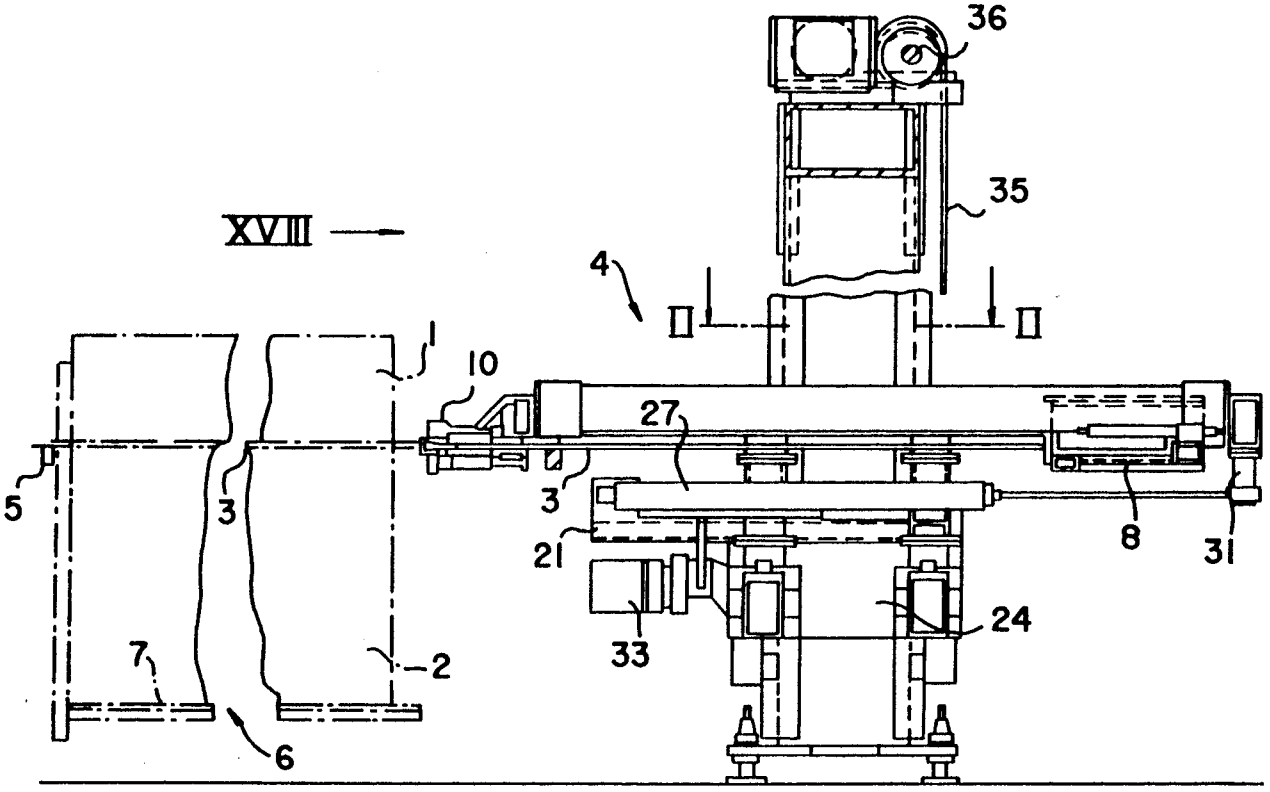
FIG. 1 is a front elevational view of a device for unifying a residual sheet pile and a main sheet pile including an auxiliary carrying device and its association with a sheet pile arrangement.

Referring now to the drawings and, first, particularly to FIG. 1 thereof, a pile arrangement is shown therein only diagrammatically and in phantom. A residual pile of sheets 1 and a main pile of sheets 2 are represented in a phase of the pile uniting process wherein the residual pile of sheets 1 is seated with its lowermost sheet on horizontally disposed lattice bars 3 of an auxiliary carrying device identified as a whole by reference numeral 4 and wherein the main pile of sheets 2 is in contact from below, with the uppermost sheet thereof against the lattice bars 3, the lattice bars 3 being in the position shown in phantom, which is offset in the longitudinal direction of the lattice bars 3 with respect to the position thereof shown in solid lines. The free ends of the lattice bars 3 projecting beyond a side surface of the pile arrangement are supported in a conventional manner by means of an auxiliary traverse or cross-member 5, shown in cross section in FIG. 1.

The main pile 2 is seated with its lowermost sheet on a pile-carrying plate 6. In a sheet feeder of a printing press, a pile of sheets seated on such a pile-carrying plate is raised, during a production run, by means of a conventional lifting mechanism to the same extent as the height of the pile of sheets decreases, until the pile finally becomes a residual pile of sheets. If the auxiliary carrying device 4, therefore, is installed in conjunction with a sheet feeder of a printing press then, prior to being united with the main pile 2, the residual pile of sheets is initially seated, likewise, with its lowermost sheet on a pile-carrying plate 6 until the pile-carrying plate 6 is removed in a conventional manner by being lowered by the aforementioned lifting mechanism after the residual pile of sheets 1 has been underpinned by means of the lattice bars 3. Mutually parallel grooves 7 are formed, in a conventional manner, on the horizontally aligned upper side of the pile-carrying plate 6. A group of the mutually parallel lattice bars 3 is assembled to form a rake 8, the cross sections of the lattice bars 3 and of the grooves 7 being so coordinated that the lattice bars can be inserted, in the longitudinal direction thereof, into the grooves 7 so that, in a phase of the uniting process, the residual pile of sheets I is underpinned by the lattice bars 3.

In order to displace the lattice bars 3 in the longitudinal direction thereof, guide rails 9 on which the rake 8 is displaceably held are provided for this purpose in the auxiliary carrying device 4.

The phase of the uniting process shown in FIG. 1, with a view of the mutual positions of the residual pile 1, the main pile 2 and the lattice bars 3 enclosed therebetween, is followed, in a final phase of the uniting process, by the removal of the lattice bars 3 from the illustrated pile arrangement, in a removal direction towards the right-hand side of FIG. 1.

Figure 4:
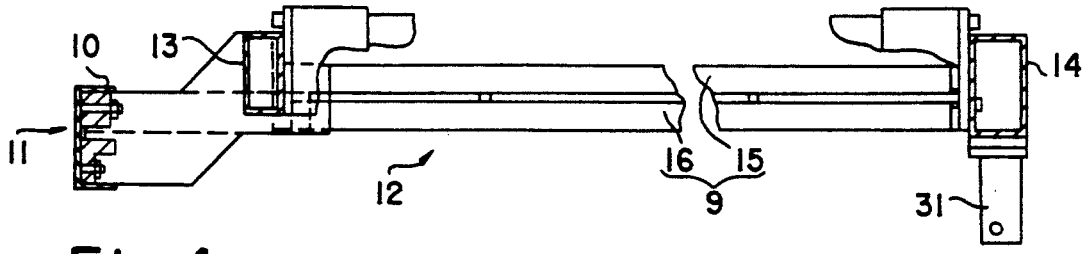
FIG. 4 is a sectional view of FIG. 3 taken along the line IV—IV in the direction of the arrows.
Figure 5:
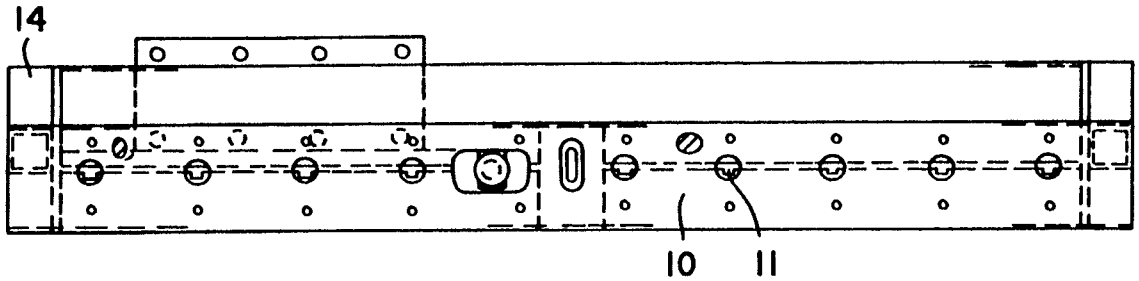
FIG. 5 is another sectional view of FIG. 3 taken along the line V—V in the direction of the arrows.

In order to prevent sheets which are in the vicinity of the lattice bars 3 from being displaced likewise in the removal direction, a conventional stop rail 10 is provided which extends transversely to the longitudinal direction of the lattice bars 3 and is displaceable in the longitudinal direction of the lattice bars 3, the stop rail 10 being formed with penetrations 11 discernible in FIGS. 4 and 5 for affording passage of the lattice bars 3 through the stop rail 10.

According to the invention, a frame 12 is formed by a pair of the hereinaforementioned guide rails 9 and the stop rail 10.

Figure 2:
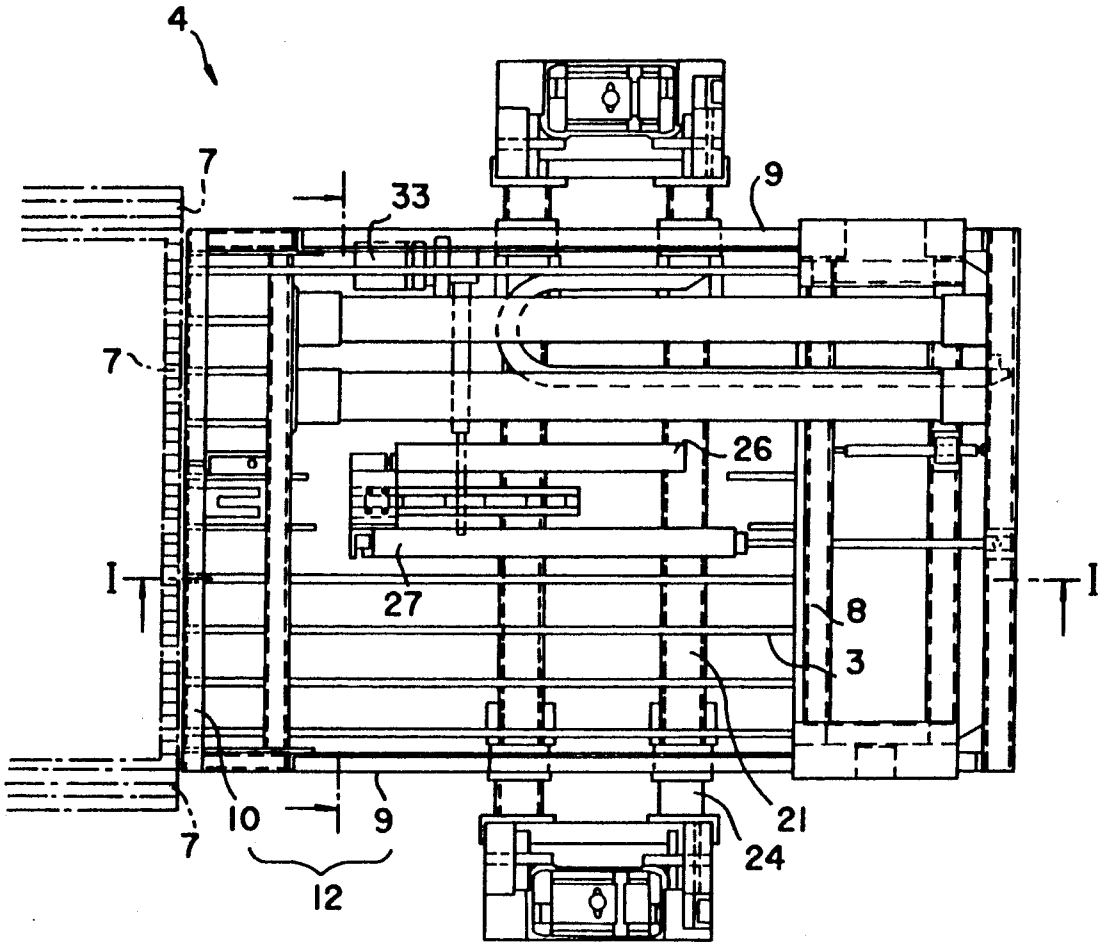
FIG. 2 is an enlarged cross-sectional view of FIG. 1 taken along the line II—II in the direction of the arrows.

As is apparent from FIG. 2, the guide rails 9, respectively, form a side part of the frame 12, and the stop rail 10 forms an end or front leg of the frame 12.

Figure 3:
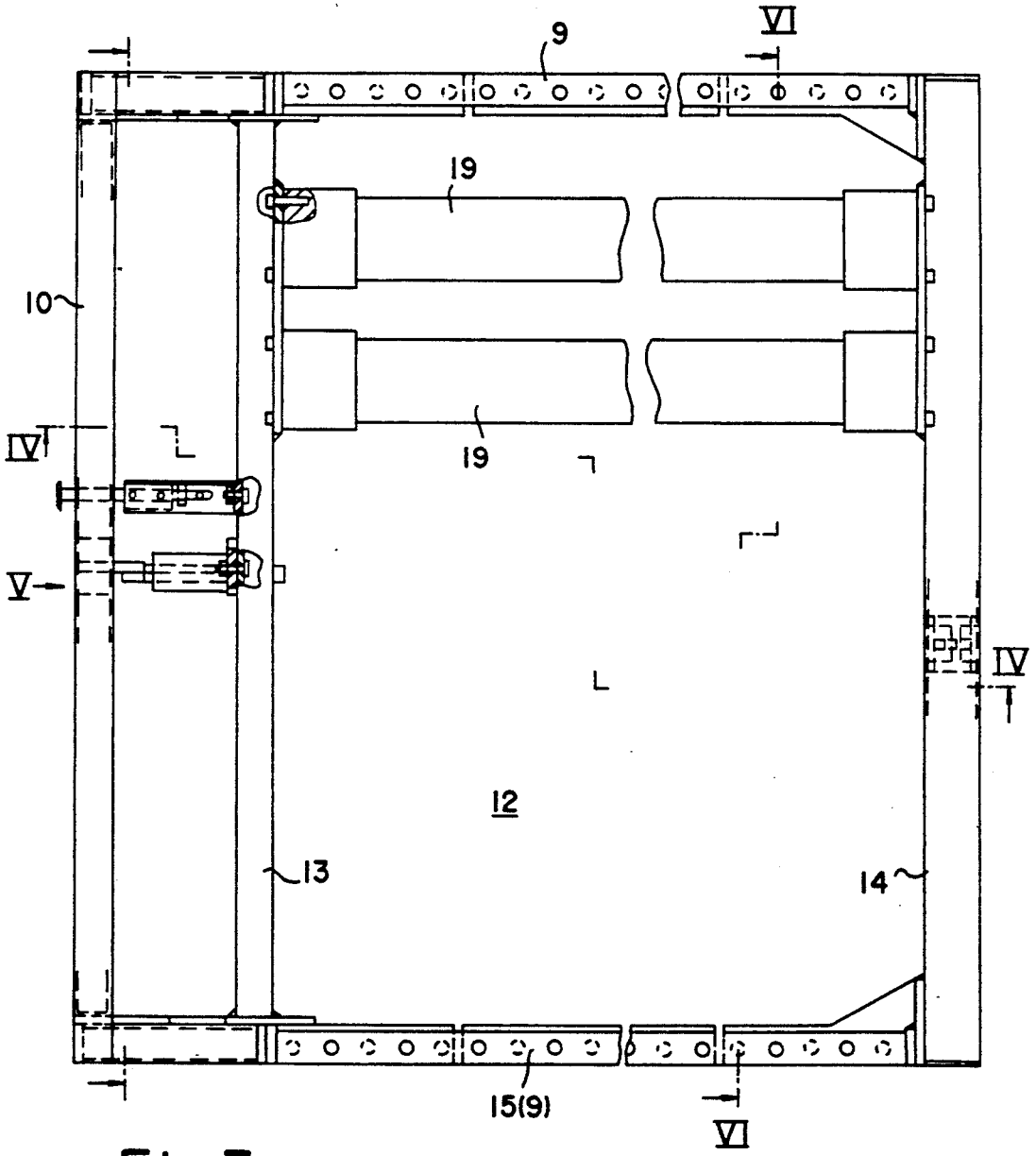
FIG. 3 is a much-enlarged fragmentary view of FIG. 2 showing a frame removed from the auxiliary carrying device of FIG. 2.

The frame 12, which is shown in FIG. 3 removed from the displacement device 4 and in a position corresponding to the position thereof shown in FIG. 2, is additionally stiffened by means of a first cross-strut 13 at a front end (situated at the left-hand side of FIG. 3) and by means of a second cross-strut 14 at a rear end of the guide rail 9 (situated at the right-hand side of FIG. 3).

Figure 6:
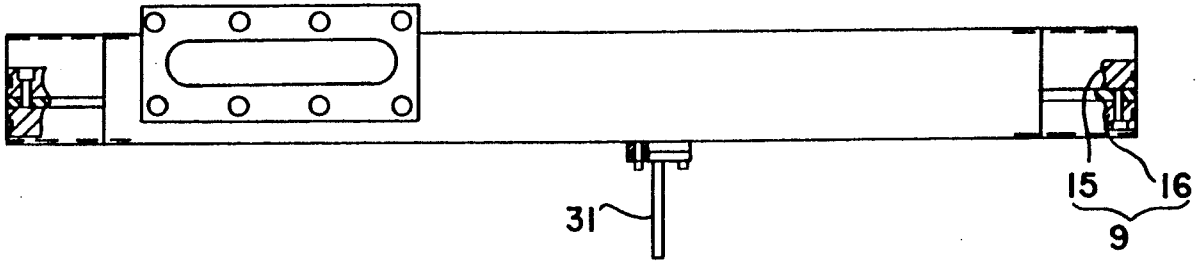
FIG. 6 is a further sectional view of FIG. 3 taken along the line VI—VI in the direction of the arrows.
Figure 7:
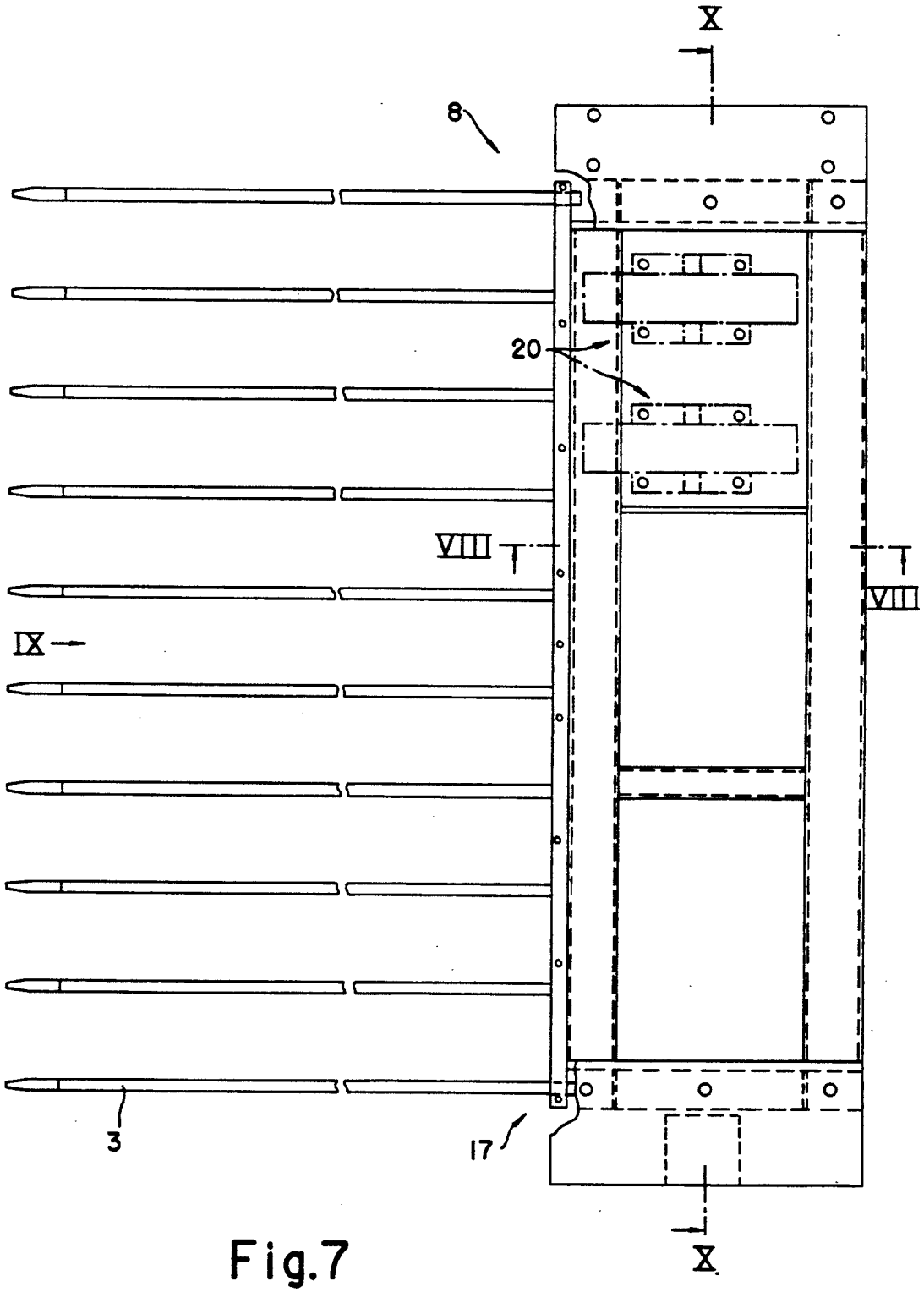
FIG. 7 is a top plan view of a rake, removed from the auxiliary carrying device of FIG. 2.

As can be seen from FIG. 6, each guide rail is assembled of an upper guide bar 15 and of a lower guide bar 16, the upper guide bar 15 serving as a straight guide for the rake 8, which is shown in FIG. 7 removed from the auxiliary carrying device 4 and in a position corresponding to the position thereof in FIG. 2. The rake i8 is formed by a bridge 17 in which the lattice bars 3 are clamped by one of the ends thereof, respectively, as can be seen most clearly in FIG. 8. The bridge 17 extends transversely to the longitudinal direction of the lattice bars 3 and has bridge bearings in the form of straight guide sections or profiles 18, each of which embraces an upper guide bar 15 of one of the guide rails 9. FIG. 9 shows how the straight guide sections 18 are connected to an upper guide bar 15, with the upper and lower guide bars 15 and 16 each being represented in phantom. The guide rails 9 and the lattice bars 3 extend parallel to one another, so that the rake 8 is supported in a manner that it is displaceable with respect to the frame 12 in the longitudinal direction of the lattice bars 3.

The illustrated embodiment provides for an independent displacement of the rake 8 with respect to the frame 12. With regard thereto, band cylinders 19 are disposed between the first and the second cross-struts 13 and 14 of the frame 12 and oriented parallel to the guide rails 9, the band cylinders 19, as indicated in phantom in FIG. 10, having bands which are connected to the bridge 17 of the rake 8. In FIG. 7, corresponding connecting means 20 for connecting the bands of the band cylinders 19 to the bridge 17 are shown diagrammatically and in phantom.

In accordance with the invention, furthermore, the frame 12 is itself mounted within the auxiliary carrying device 4 so that it is displaceable in the longitudinal direction of the lattice bars 3 and in a horizontal plane transverse to the longitudinal direction of the lattice bars 3. In the embodiment of FIGS. 1 and 2, the auxiliary carrying device is equipped with a cross-slide arrangement formed of a cross-slide 21 and a telescopic slide.

Figure 11:
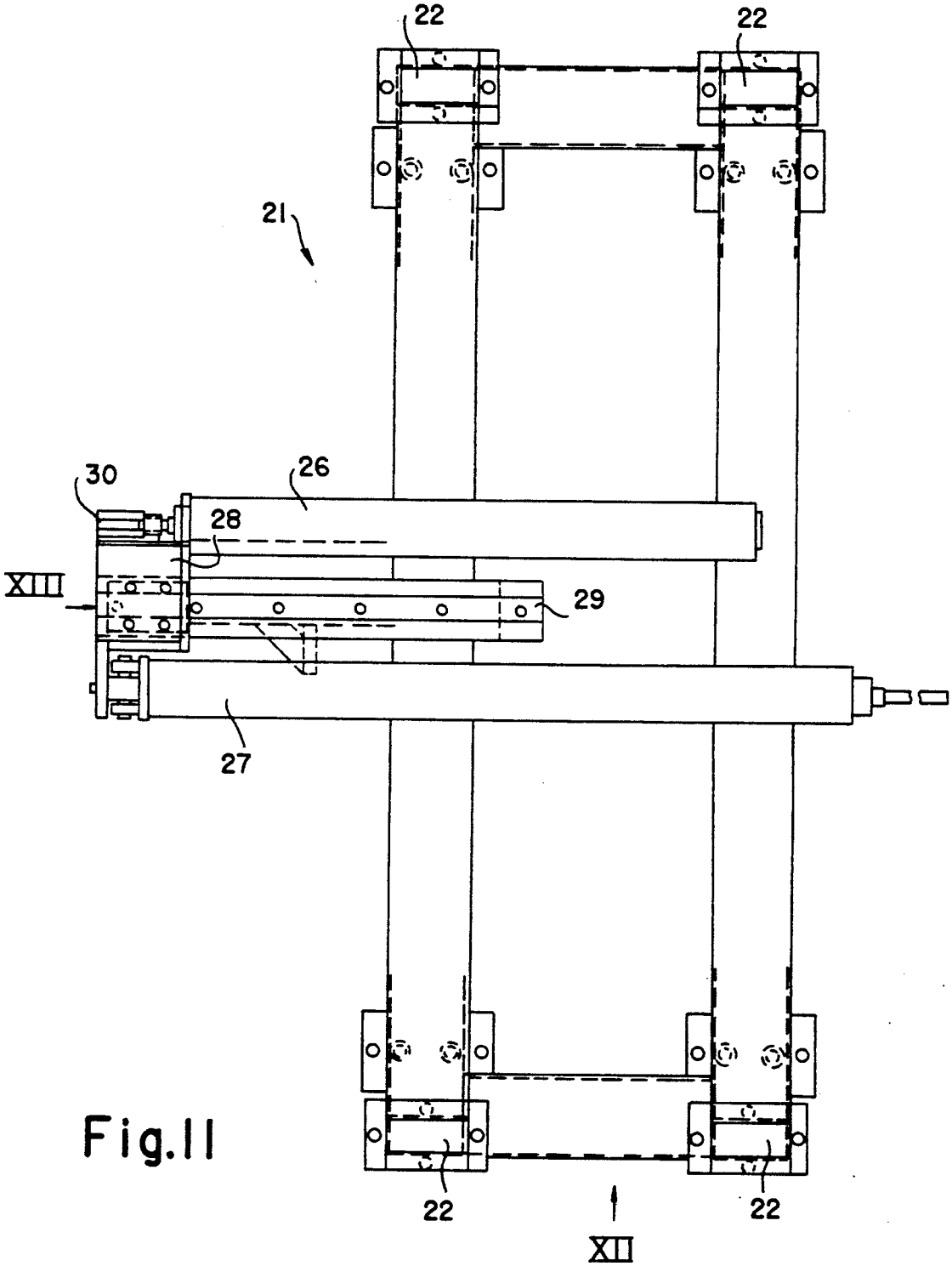
FIG. 11 is a top plan view of a cross-slide removed from the auxiliary carrying device of FIG. 2.

The cross-slide 21, which is illustrated in FIG. 11 removed from the auxiliary carrying device 4 and in a position corresponding to the position thereof shown in FIG. 2, extends transversely to the lattice bars 3 from a guide rail 9 on a first longitudinal side of the frame 12 to the opposite guide rail 9 on a second longitudinal side of the frame 12, and has straight guide sections corresponding to the straight guide sections 18 (FIGS. 9 and 10) provided on the rake 8. These straight guide sections 22 embrace a respective lower guide bar 16 of a respective guide rail 9. Thus, the frame 12 forms a first slide of the telescopic slide, the first slide being guided by the cross-slide 21 in the longitudinal direction of the lattice bars 3, a second slide of the telescopic slide being represented by the rake 8 which is mounted on the frame 12 and is displaceable likewise in the longitudinal direction of the lattice bars 3.

Figure 12:
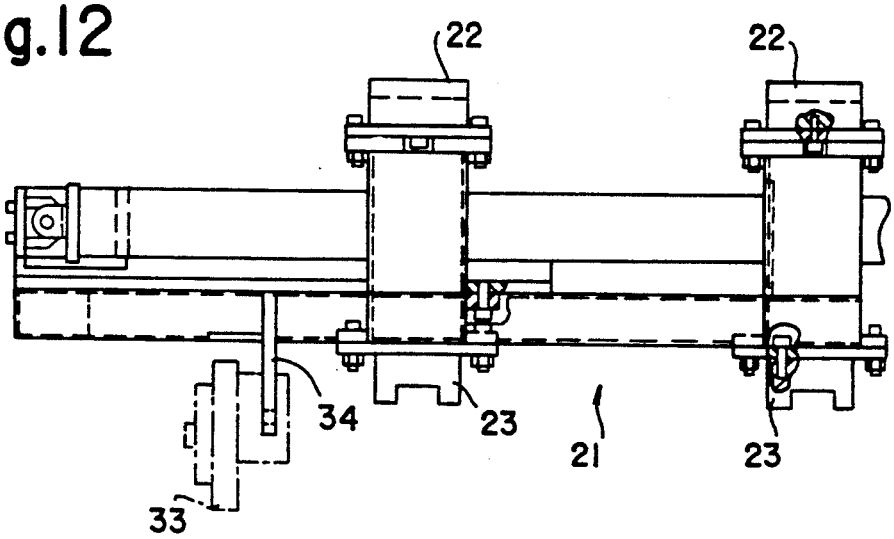
FIG. 12 is a side elevational view of the cross-slide as seen in the direction of arrow XII in FIG. 11.
Figure 13:
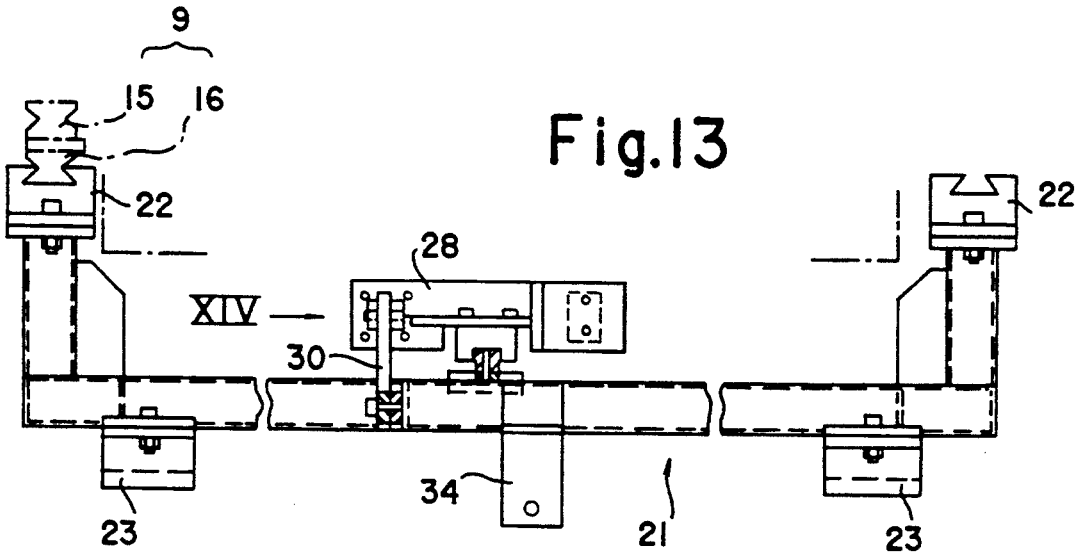
FIG. 13 is another side elevational view of the cross-slide as seen in the direction of arrow XIII in FIG. 11.
Figure 14:
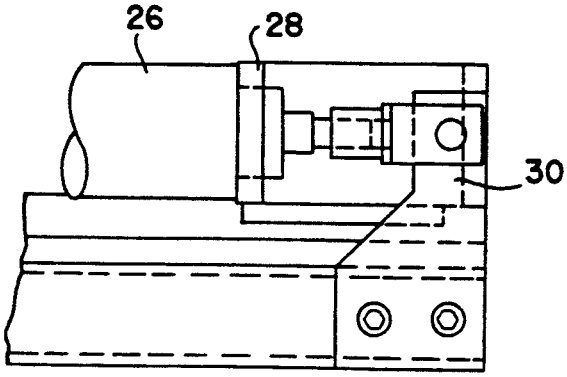
FIG. 14 is an enlarged fragmentary elevational view in the direction of arrow XIV in FIG. 13.

The cross slide 21 is equipped with other straight guide sections 23 oriented transversely with respect to the lattice bars 3 (note FIGS. 12 and 13).

The auxiliary carrying device 4, furthermore, has a slide-guiding bed 24. The slide-guiding bed 24 shown in FIG. 15, removed from the auxiliary carrying device 4 and disposed in a position corresponding to the position thereof in FIG. 2, is provided with horizontally extending straight-guide tracks 25 oriented transversely to the lattice bars 3 and being in engagement with straight-guide sections or profiles 23 provided on the cross-slide 21. Consequently, the cross-slide 21 is disposed so as to be horizontally displaceable transversely to the longitudinal direction of the lattice bars 3.

The illustrated embodiment of the invention provides for the independent placement of the frame 12 with respect to the cross-slide 21. In this regard, a piston-cylinder arrangement is provided which includes a first cylinder 26 and a second cylinder 27 and which acts between the cross-slide 21, on the one hand, and the frame 12, on the other hand. The first cylinder 26 is flanged onto a guide head 28, which is guided by means of a slideway 29 oriented in the longitudinal direction of the lattice bars 3 and attached to the cross-slide 21, while the piston rod of the first cylinder 26 is swivel-mounted on a strap 30 attached to the cross-slide 21 (see FIGS. 11, 12, 13 and 14). the second cylinder 27 is articulatingly mounted at its one end on the guide head 28, while the end of the piston rod of the second cylinder 27 facing away from the one end is connected in an articulating manner to a further strap 31 (note FIG. 2, for example), which, in turn, is attached to the frame 12.

Figure 16:
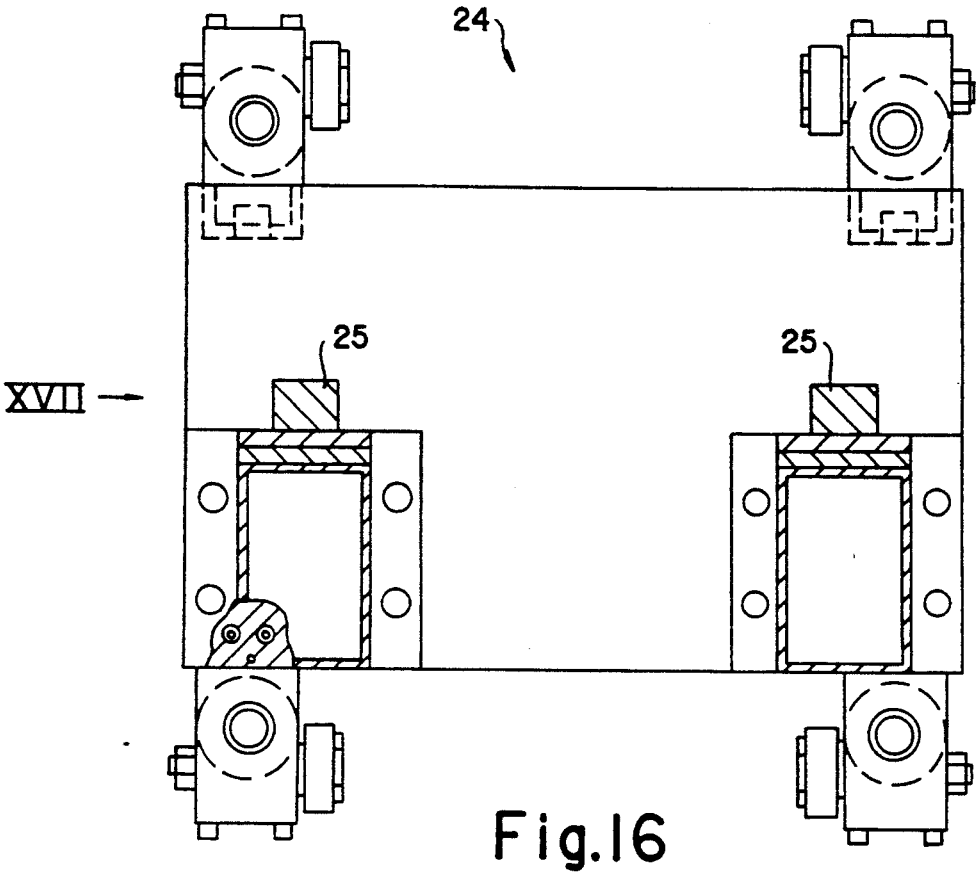
FIG. 16 is a sectional view of FIG. 15 taken along the line XVI—XVI in the direction of the arrows.
Figure 15:
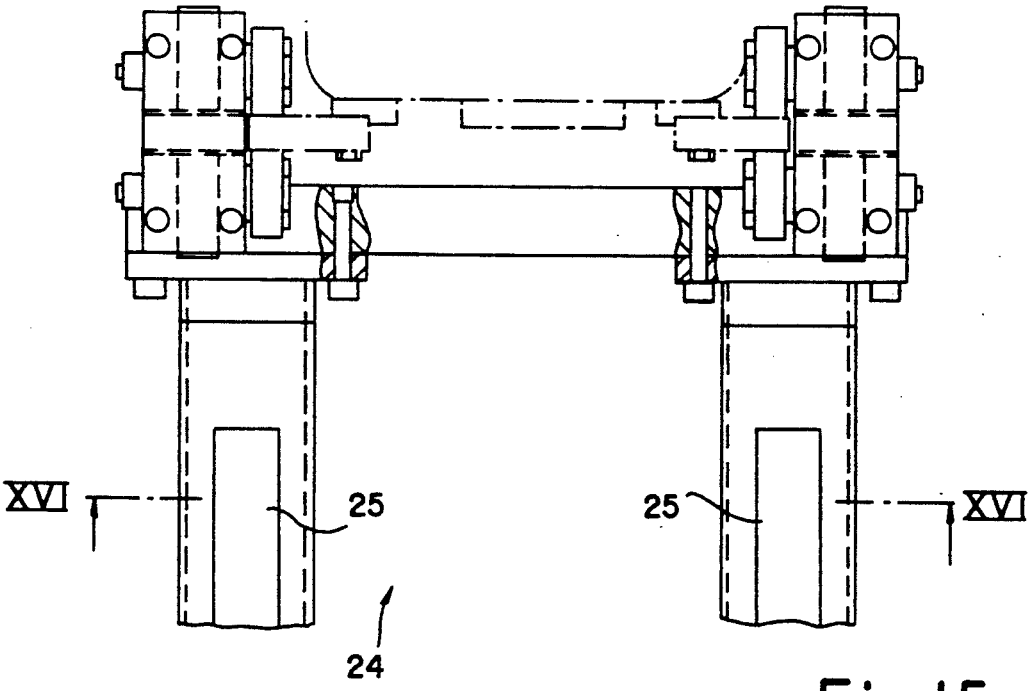
FIG. 15 is a much-enlarged fragmentary view of FIG. 2 showing a slide-guiding bed thereof removed from the auxiliary carrying device.
Figure 17:
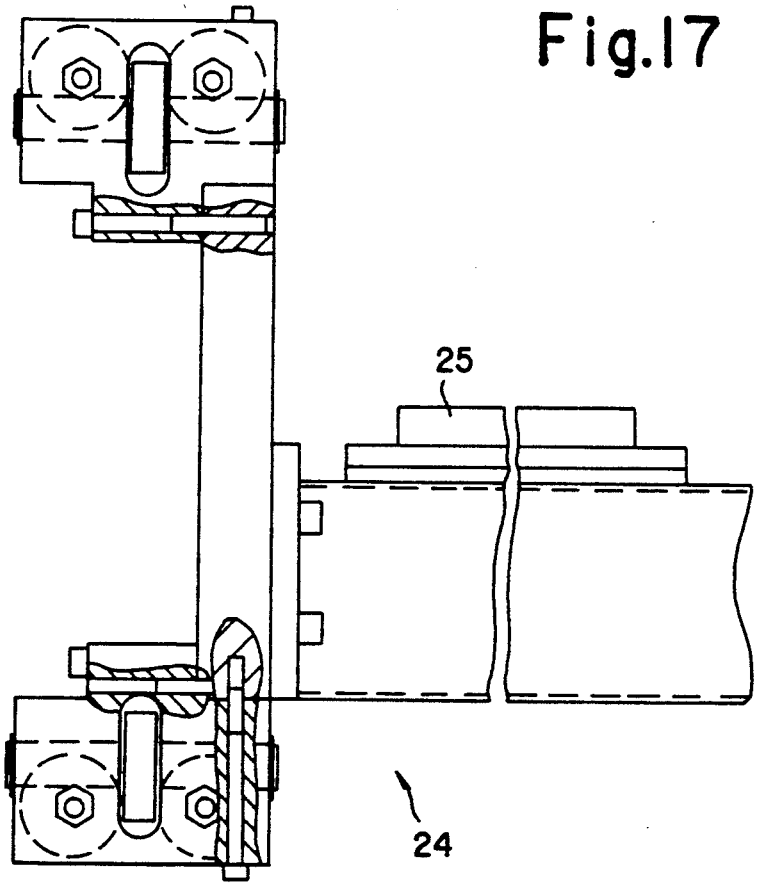
FIG. 17 is a side elevational view of the cross-member arrangement as seen in the direction of arrow XVII in FIG. 16.
Figure 18:
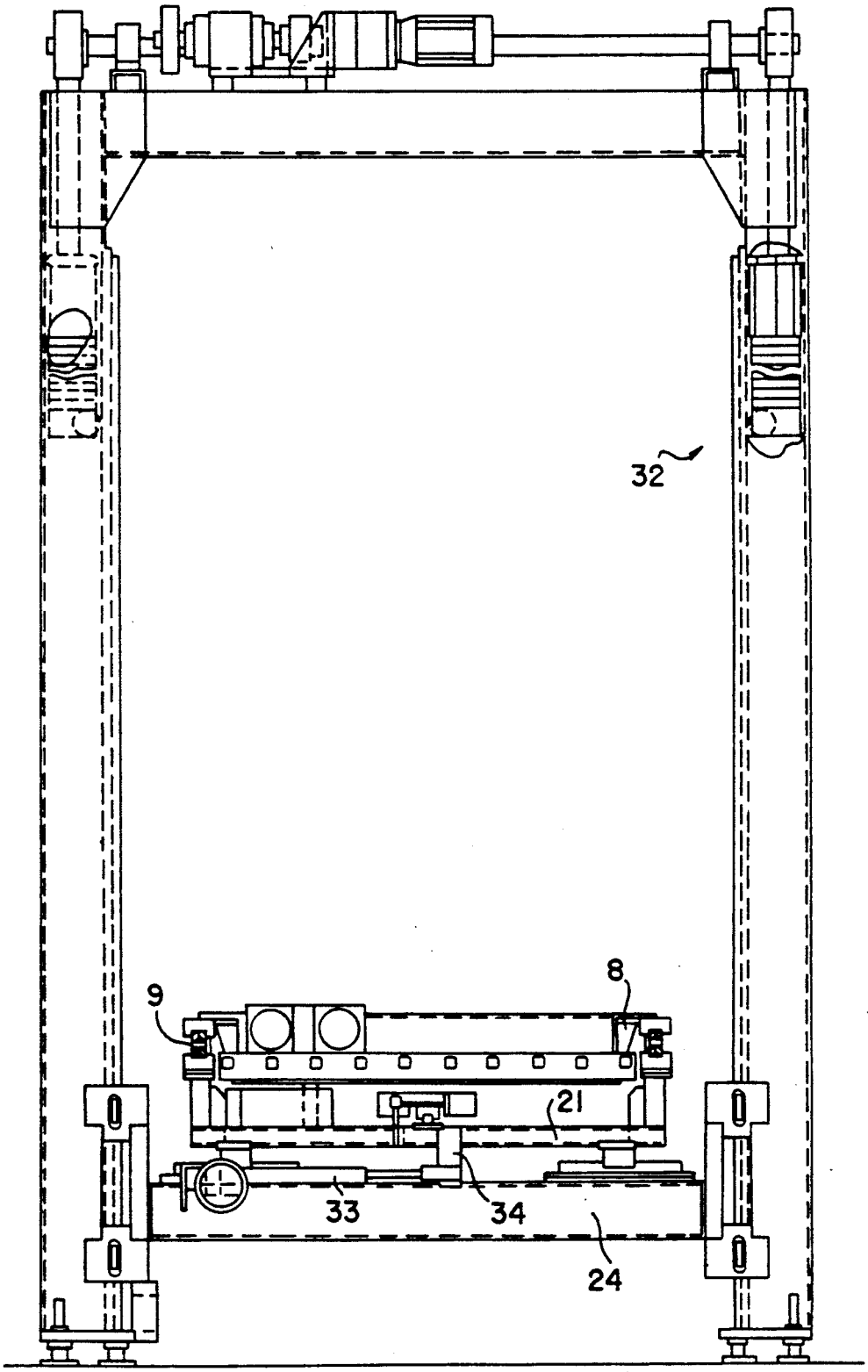
FIG. 18 is an elevational view of the device according to the invention as seen in the direction of arrow XVIII in FIG. 1.

In order to use the device according to the invention in conjunction with a sheet feeder of a printing machine, the slide-guiding bed 24, as shown in FIGS. 15, 16 and 17, is in the form of a lift truck which can be moved vertically along a lifting cradle 32 (note FIG. 18). In order to move the lift truck along the lifting cradle 32, the slide-guiding bed 24 is connected to a lifting drive 36 through the intermediary of traction means 35, such as a chain or a toothed belt (note FIG. 1). In this regard, the afore-described piston-cylinder unit has an advantageous effect to the extent that, with separate activation of the two cylinders 26 and 27, for example, rapid traversing movements of the auxiliary carrying device 4 are possible vertically, for example, from a rest position to a standby position, with increased spacing between the stop rail 10 and a side face of the residual pile of sheets 1 facing towards the stop rail 10. Moreover, the above-described piston-cylinder unit provides a further telescoping effect for the aforementioned telescopic slide.

The embodiment of the invention further provides for an independent displacement of the cross-slide 21 with respect to the slide-guiding bed 24. For this purpose, a linear servo-drive 33 is mounted on the slide-guiding bed 24 and a pushrod of the linear servo-drive 33 is articulatingly connected to another strap 34 which is fastened to the cross-slide 21.

We claim:

1. Device for uniting a residual pile of sheets and a main pile of sheets into an aggregate pile, wherein a lowermost sheet of the residual pile of sheets rests on an uppermost sheet of the main pile of sheets, comprising a pile-carrying plate having a horizontally oriented upper side whereon the residual pile of sheets rests with its lowermost sheet prior to a performance of a pile uniting process, said pile-carrying plate having mutually parallel grooves formed on said upper side thereof, an auxiliary carrying device for temporarily carrying the residual pile of sheets including an assembly of horizontally disposed and mutually parallel lattice bars fitting into respective cross sections of said grooves formed in said pile-carrying plate and combined into a rake, guide rails whereon said rake is mounted so as to be displaceable in the longitudinal direction of said lattice bars, a stop rail extending transversely to and being displaceable in the longitudinal direction of said lattice bars, said stop rail being formed with penetrations through which said lattice bars are capable of passing through said stop rail, said lattice bars being insertable in the longitudinal direction thereof into said grooves formed in said pile-carrying plate so as to underpin the residual pile of sheets, in a phase of the pile uniting process and, in a further phase of the uniting process, said pile-carrying plate being removed from the residual pile of sheets, the residual pile of sheets resting with its lowermost sheet on said lattice bars and the main pile of sheets being in contact with its uppermost sheet from below against said lattice bars and, in a final phase of the uniting process, said lattice bars, situated between the residual pile of sheets and the main pile of sheets, being pulled in a removal direction, while said stop rail is brought into contact against the residual pile of sheets and the main pile of sheets so that sheets of the residual pile of sheets and of the main pile of sheets which are in vicinity of said lattice bars are prevented from being displaced in said removal direction, an auxiliary carrying device having a frame, said guide rails and said stop rail being fixed components of said frame, and said frame being mounted within said auxiliary carrying device so as to be displaceable in the longitudinal direction of said lattice bars and in a horizontal plane transverse to the longitudinal direction of said lattice bars.

2. Device according to claim 1, wherein said auxiliary carrying device comprises a cross-slide arrangement formed of a cross-slide and a telescopic slide, said cross-slide being horizontally displaceable transversely to the longitudinal direction of said lattice bars, and said telescopic slide comprising a first slide forming said frame and being guided by said cross-slide in the longitudinal direction of said lattice bars, and a second slide forming said rake and being guided by said first slide in the longitudinal direction of said lattice bars.

* * * * *